US012054841B2

(12) United States Patent
Ideguchi et al.

(10) Patent No.: US 12,054,841 B2
(45) Date of Patent: Aug. 6, 2024

(54) APPARATUS FOR PLATING AND METHOD OF PLATING

(71) Applicant: EBARA CORPORATION, Tokyo (JP)

(72) Inventors: Kazuma Ideguchi, Tokyo (JP); Hideki Wakabayashi, Tokyo (JP); Ryuya Koizumi, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 17/895,558

(22) Filed: Aug. 25, 2022

(65) Prior Publication Data

US 2023/0146732 A1 May 11, 2023

(30) Foreign Application Priority Data

Nov. 5, 2021 (JP) ..... 2021-181295

(51) Int. Cl.
*C25D 21/12* (2006.01)
*C25D 5/02* (2006.01)
*C25D 17/00* (2006.01)

(52) U.S. Cl.
CPC ..... *C25D 21/12* (2013.01); *C25D 5/022* (2013.01); *C25D 17/001* (2013.01); *C25D 17/008* (2013.01)

(58) Field of Classification Search
CPC ..... C25D 7/12–123; C25D 17/001; H01L 21/2885; H01L 21/76873; H01L 2224/11462
See application file for complete search history.

(56) References Cited

U.S. PATENT DOCUMENTS 5,344,491 A * 9/1994 Katou ..... C25D 7/123 204/239
2018/0294174 A1* 10/2018 Fujikata ..... H01L 21/68707
(Continued)

FOREIGN PATENT DOCUMENTS

JP 6538541 B2 6/2017
JP 6860406 B2 11/2018
JP 2019-056164 A 4/2019

OTHER PUBLICATIONS

Haidekker, Linear Feedback Controls[,] The Essentials (Year: 2013).*
(Continued)

*Primary Examiner* — Hosung Chung
(74) *Attorney, Agent, or Firm* — BakerHostetler

(57) ABSTRACT

One object of the present disclosure is to improve the accuracy of detection of an abnormality of various devices, and/or to advance the timing of detection of an abnormality. There is provided an apparatus for plating a substrate, comprising: an anode placed to be opposed to the substrate; an electric field regulating member placed between the substrate and the anode, provided with an opening, and equipped with an opening adjustment member configured to change a dimension of the opening; a motor configured to drive the opening adjustment member; and a control device configured to obtain an electric current value or a load factor of the motor, to calculate an amount of change in the load factor of the motor per unit time from the obtained electric current value or the obtained load factor of the motor, and to detect an abnormality of the electric field regulating member when it is detected that the amount of change in the load factor of the motor per unit time exceeds a predetermined threshold value.

7 Claims, 8 Drawing Sheets

(56) References Cited

U.S. PATENT DOCUMENTS

| | | | | |
|---|---|---|---|---|
| 2019/0093250 | A1* | 3/2019 | Yamasaki | C25D 5/04 |
| 2020/0270760 | A1 | 8/2020 | Nakagawa et al. | |

OTHER PUBLICATIONS

Lou et al., Electroplating, Encyclopedia of Chem. Proc. (Year: 2006).*

* cited by examiner

APPARATUS FOR PLATING AND METHOD OF PLATING

TECHNICAL FIELD

The present disclosure relates to an apparatus for plating and a method of plating.

BACKGROUND ART

Wirings, bumps (salient electrodes), and the like are formed on a surface of a substrate such as a semiconductor wafer or a printed circuit board. An electroplating technique has been known as a method of forming such wirings, bumps and the like. In a plating apparatus that performs electroplating, a substrate (wafer) is placed to be opposed to an anode in a plating solution, and electric current is flowed from the anode to the substrate that serves as a cathode, so that a metal plating film is formed on the surface of the substrate. In such a plating apparatus, an anode mask for regulating an electric field between the anode and the substrate may be placed to adjust the electric field from the anode to the substrate. The anode mask is described in, for example, Japanese Patent No. 6538541 (Patent Document 1) and Japanese Unexamined Patent Publication No. 2019-56164 (Patent Document 2). Such an anode mask has an opening, which an electric field (electric current) from the anode passes through, and includes a moving member in the form of blades or vanes to adjust the dimension of the opening. The blades or the vanes are regulated, for example, by the power from a motor.

A method of detecting a failure of various devices such as an anode mask in a semiconductor manufacturing apparatus has, on the other hand, been proposed; for example, a method described in, for example, Japanese Patent No. 6860406 (Patent Document 3). This failure detection method provides a plurality of failure models, compares a characteristic amount vector of a measured physical quantity with characteristic amount vectors at respective time points in the plurality of failure models, specifies a failure model having a minimum deviation between the characteristic amount vectors, and calculates a predicted failure time from the specified failure model.

RELATED ART DOCUMENT

Patent Document

Patent Document 1: Japanese Patent No. 6538541
Patent Document 2: Japanese Unexamined Patent Publication No. 2019-56164
Patent Document 3: Japanese Patent No. 6860406

SUMMARY OF INVENTION

The failure detection method using the failure models enables an indication of a possible failure of various devices to be detected with high accuracy during long-time use of a plating apparatus. In some cases, however, an abnormality, a failure or a damage of the device may occur without any indication of a failure or immediately after an indication of a failure. There is also a problem that it is difficult to detect an abnormality, a failure or a damage of an anode mask in the case of a small deviation of electric current in an abnormal state from that in a normal state, for example, at or during start of operation of the anode mask. Continuing a plating process without noticing that the anode mask is damaged causes an abnormal plating process and may result in scrapping processed wafers.

Another problem is a difficulty in stopping operation of a device such as an anode mask and preventing the device from being actually damaged. For example, in a configuration of detecting an abnormality by comparing a load factor of a motor used to drive an anode mask having a variable opening diameter with a threshold value, in the actual use, the threshold value for detection of an abnormality may be set to a slightly higher value with a view to preventing misdetection of a failure of the anode mask. In this case, where is a time lag until the load factor of the motor starts increasing and exceeds the threshold value. It is too late to stop the operation of the device after the load factor exceeds the threshold value. This may cause the anode mask to be damaged. The damage of the anode mask is likely to cause a downtime for recovery work and generate a cost for component replacement or the like.

One object of the present disclosure is to improve the accuracy of detection of an abnormality of various devices, and/or to advance the timing of detection of an abnormality. One object of the present disclosure is to enable an abnormality, if there is any, of various devices such as an electric field regulating member to be detected at or during start of operation of the device. One object of the present disclosure is to detect an abnormality of various devices such as an electric field regulating member prior to damage of the device, stops operation of the device and thereby prevents the device from being actually damaged.

According to one aspect, there is provided an apparatus for plating a substrate, comprising: an anode placed to be opposed to the substrate; an electric field regulating member placed between the substrate and the anode, provided with an opening, and equipped with an opening adjustment member configured to change a dimension of the opening; a motor configured to drive the opening adjustment member; and a control device configured to obtain an electric current value or a load factor of the motor, to calculate an amount of change in the load factor of the motor per unit time from the obtained electric current value or the obtained load factor of the motor, and to detect an abnormality of the electric field regulating member when it is detected that the amount of change in the load factor of the motor per unit time exceeds a predetermined threshold value.

DESCRIPTION OF EMBODIMENTS

Figure 1:
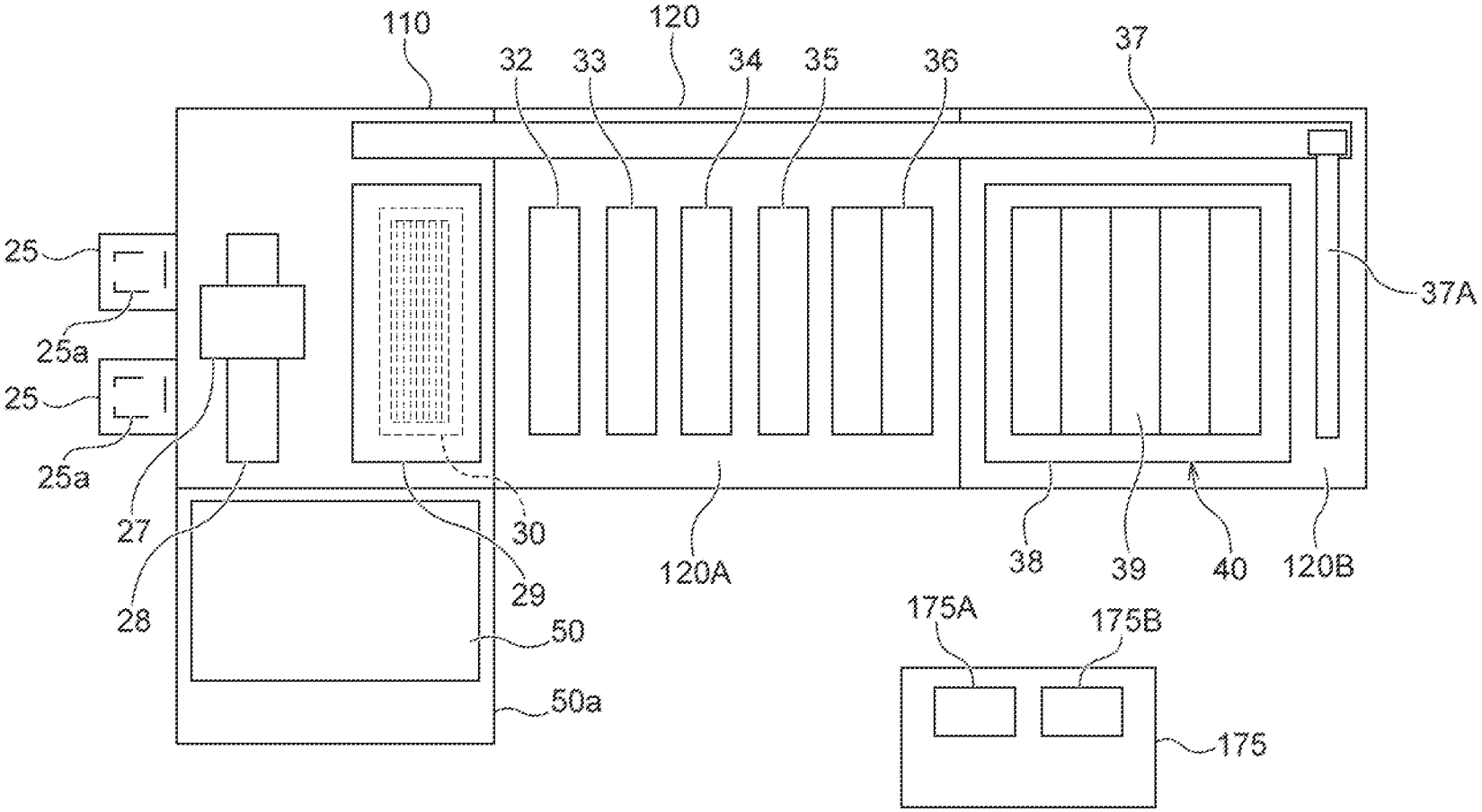
FIG. 1 is an overall arrangement drawing illustrating a plating apparatus according to one embodiment.

The following describes embodiments of the present disclosure with reference to drawings. In the drawings attached, identical or similar elements are expressed by identical or similar reference signs. In the description of the respective embodiments, duplicated description on the identical or similar elements may be omitted. The features and the characteristics shown in each of the embodiment are also applicable to the other embodiments unless they are contradictory to each other.

In the description hereof, a term "substrate" includes not only semiconductor substrates, glass substrates, liquid crystal substrates and printed circuit boards but magnetic recording media, magnetic recording sensors, mirrors, optical elements, micromachine elements, partially fabricated integrated circuits, and any other objects to be processed. The "substrate" includes those having any arbitrary shapes, such as a polygonal shape and a circular shape. In the description hereof, the expressions such as "front face", "rear face", "front", "back". "upper" or "upward", "lower" or "downward". "left" or "leftward" and "right" and "rightward" are used. These expressions indicate the positions, the orientations, and the directions on the sheet surface of the illustrated drawings for the purpose of explanation, and these positions, orientations and directions may be different from those in the actual arrangement, for example, when using the apparatus.

First Embodiment

FIG. 1 is an overall arrangement drawing illustrating a plating apparatus according to one embodiment. The plating apparatus 100 is configured to plate a substrate in such a state that the substrate is held by a substrate holder 11 (shown in FIG. 2). The plating apparatus 100 is roughly divided into a loading/unloading station 110 configured to load the substrate to the substrate holder 11 or unload the substrate from the substrate holder 11; a processing station 120 configured to process the substrate; and a cleaning station 50*a*. The processing station 120 includes a preprocess and postprocess station 120A configured to perform a preprocess and a postprocess of the substrate and a plating station 120B configured to perform a plating process of the substrate.

The loading/unloading station 110 includes one or a plurality of cassette tables 25 and a substrate mounting/demounting module 29. The cassette table 25 allows a cassette 25*a* with a substrate placed therein to be mounted thereon. The substrate mounting/demounting module 29 is configured to mount the substrate to the substrate holder 11 and demount the substrate from the substrate holder 11. A stocker 30 configured to place the substrate holder 11 therein is provided in the vicinity of (for example, below) the substrate mounting/demounting module 29. The cleaning station 50*a* has a cleaning module 50 configured to clean the substrate after the plating process and dry the cleaned substrate. The cleaning module 50 is, for example, a spin rinse dryer.

A transfer robot 27 is placed at a location surrounded by the cassette tables 25, the substrate mounting/demounting module 29 and the cleaning station 50*a* to transfer the substrate between these units. The transfer robot 27 is configured to be travelable by a traveling mechanism 28. The transfer robot 27 is configured, for example, to take out a substrate before plating from the cassette 25*a* and transfer the substrate before plating to the substrate mounting/demounting module 29, to receive a substrate after plating from the substrate mounting/demounting module 29, to transfer the substrate after plating to the cleaning module 50, and to take out a cleaned and dried substrate from the cleaning module 50 and place the cleaned and dried substrate into the cassette 25*a*.

The preprocess and postprocess station 120A includes a pre-wet module 32, a pre-soak module 33, a first rinse module 34, a blow module 35 and a second rinse module 36. The pre-wet module 32 wets a surface to be plated or a plating surface of the substrate before the plating process with a process liquid, such as pure water or deaerated water, so as to replace the air inside a pattern formed on the surface of the substrate with the process liquid. The pre-wet module 32 is configured to perform a pre-wet process that replaces the process liquid inside the pattern with a plating solution during plating and thereby facilitates supplying the plating solution to the inside of the pattern. The pre-soak module 33 is configured to perform a pre-soak process that removes an oxidized film of a large electrical resistance present on, for example, the surface of a seed layer formed on the plating surface of the substrate before the plating process by etching using a process liquid, such as sulfuric acid or hydrochloric acid, and cleans or activates the surface of a plating base layer. The first rinse module 34 cleans the substrate after the pre-soak process along with the substrate holder 11 by using a cleaning solution (for example, pure water). The blow module 35 drains the liquid from the substrate after cleaning. The second rinse module 36 cleans the substrate after plating along with the substrate holder 11 by using a cleaning solution. The pre-wet module 32, the pre-soak module 33, the first rinse module 34, the blow module 35 and the second rinse module 36 are placed in this sequence. This configuration is only an example, and the preprocess and postprocess station 120A is not limited to the configuration described above but may adopt another configuration.

The plating station 120B includes a plating module 40 that has a plating tank 39 and an overflow tank 38. The plating tank 39 is divided into a plurality of plating cells. Each of the plating cells has one substrate placed inside thereof and soaks the substrate in a plating solution kept inside thereof, so as to plate the surface of the substrate, for example, by copper plating. The type of the plating solution is not specifically limited, but various plating solutions may be used according to their uses and applications. This configuration of the plating station 120B is only one example, and the plating station 120B may adopt another configuration.

The plating apparatus 100 also includes a transfer device 37 that employs, for example, a linear motor system and that is located on a lateral side of these respective devices described above to transfer the substrate holder 11 along with the substrate between these devices. This transfer device 37 has one or a plurality of transporters and is configured to transfer the substrate holder 11 between the substrate mounting/demounting module 29, the stocker 30, the pre-wet module 32, the pre-soak module 33, the first rinse module 34, the blow module 35, the second rinse module 36, and the plating module 40 by the one or plurality of transporters.

The plating apparatus 100 configured as described above has a control module (controller) 175 serving as a control portion configured to control the respective portions described above. The controller 175 includes a memory 175B configured to store predetermined programs therein and a CPU 175A configured to perform the programs stored in the memory 175B. A storage medium that configures the memory 175B stores a variety of set data and various programs including programs of controlling the plating apparatus 100. The programs include, for example, programs of performing transfer control of the transfer robot 27, mounting and demounting control of the substrate to and from the substrate holder 11 in the substrate mounting/demounting module 29, transfer control of the transfer device 37, controls of the processings in the respective processing modules, control of the plating process in the plating module 40, and control of the cleaning station 50*a*, as well as programs of detecting abnormalities or failures of the respective devices. The storage medium may include a non-volatile storage medium and/or a volatile storage medium. The storage medium used herein may be any of computer readable known storage media, for example, memories such as ROMs, RAMs, flash memories and disk-shaped storage media such as hard disks. CD-ROMs, DVD-ROMs and flexible disks.

The controller 175 is configured to make communication with a non-illustrated upper-level controller that comprehensively controls the plating apparatus 100 and other relevant apparatuses and to exchange data with a database included in the upper level controller. Part or the entirety of the functions of the controller 175 may be configured by hardware, such as an ASIC. Part or the entirety of the functions of the controller 175 may also be configured by a PLC, a sequencer or the like. Part or the entirety of the controller 175 may be placed inside and/or outside of the housing of the plating apparatus 100. Part or the entirety of the controller 175 is connected to make communication with the respective portions of the plating apparatus 100 by wire and/or wirelessly.

(Plating Module)

Figure 2:
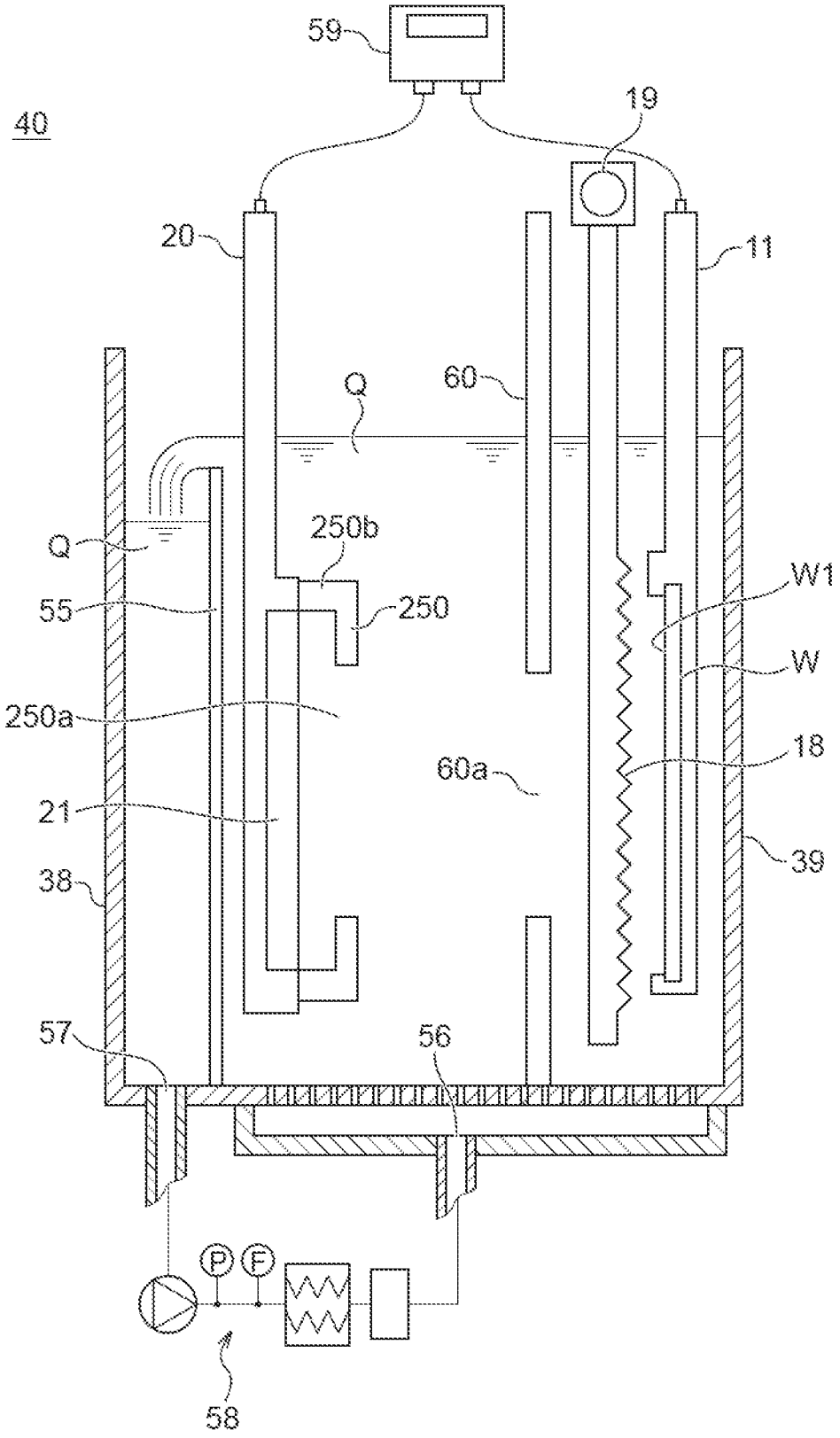
FIG. 2 is a schematic sectional side view illustrating a plating module.

FIG. 2 is a schematic sectional side view illustrating the plating module 40. As illustrated, the plating apparatus 100 according to the embodiment includes an anode holder 20 configured to hold an anode 21, the substrate holder 11 configured to hold a substrate W, and the plating tank 39 configured to place the anode holder 20 and the substrate holder 11 inside thereof. FIG. 2 illustrates a configuration corresponding to only one plating cell.

As shown in FIG. 2, the plating tank 39 keeps therein a plating solution Q including an additive or additives. The overflow tank 38 is provided to receive and discharge the plating solution Q overflowing from the plating tank 39. The plating tank 39 and the overflow tank 38 are parted from each other by a partition wall 55.

The anode holder 20 that holds the anode 21 and the substrate holder 11 that holds the substrate W are soaked in the plating solution Q kept in the plating tank 39 and are arranged to be opposed to each other in such a manner that the anode 21 and a surface to be plated or a plating surface W1 of the substrate W are approximately parallel to each other. A voltage is applied from a plating power supply 59 in the state that the anode 21 and the substrate W are soaked in the plating solution Q of the plating tank 39. This causes the metal ion to be reduced on the plating surface W1 of the substrate W and forms a plating film on the plating surface W1.

The plating tank 39 has a plating solution supply port 56 from which the plating solution Q is supplied to the inside of the plating tank 39. The overflow tank 38 has a plating solution discharge port 57 from which the plating solution Q overflowing from the plating tank 39 is discharged. The plating solution supply port 56 is placed in a bottom portion of the plating tank 39, and the plating solution discharge port 57 is placed in a bottom portion of the overflow tank 38.

When the plating solution Q is supplied from the plating solution supply port 56 into the plating tank 39, the plating solution Q overflows from the plating tank 39 and flows over the partition wall 55 into the overflow tank 38. The plating solution Q flowing into the overflow tank 38 is discharged from the plating solution discharge port 57 and is subjected to removal of impurities by means of, for example, a filter provided in a plating solution circulation device 58. The plating solution Q after the removal of impurities is supplied through the plating solution supply port 56 into the plating tank 39 by the plating solution circulation device 58.

The anode holder 20 has an anode mask 250 configured to regulate an electric field between the anode 21 and the substrate W. The anode mask 250 is, for example, a substantially plate-like member made of a dielectric material and is provided on a front face of the anode holder 20. The front face of the anode holder 20 herein means a surface on a side opposed to the substrate holder 11. In other words, the anode mask 250 is placed between the anode 21 and the substrate holder 11. The anode mask 250 has an opening 250*a* formed at an approximate center thereof such as to allow electric current (electric field) flowing between the anode 21 and the substrate W to pass through. It is preferable that the opening 250*a* has a diameter that is smaller than the diameter of the anode 21. As described later, the anode mask 250 is configured to allow the diameter of the opening 250*a* to be regulated.

The anode mask 250 has an anode mask mounting element 250*b* provided on an outer circumference thereof to integrally mount the anode mask 250 to the anode holder 20. The position of the anode mask 250 is required to be between the anode holder 20 and the substrate holder 11. It is, however, preferable that the anode mask 250 is located at a position closer to the anode holder 20 than the middle position between the anode holder 20 and the substrate holder 11. In another example, the anode mask 250 may not be mounted to the anode holder 20 but may be placed on a front face of the anode holder 20. The configuration that the anode mask 250 is mounted to the anode holder 20 like the embodiment described above, however, fixes the relative position of the anode mask 250 to the anode holder 20 and thereby prevents misalignment between the position of the anode 21 and the position of the opening 250*a*.

It is preferable that the anode 21 held by the anode holder 20 is an insoluble anode. When the anode 21 is an insoluble anode, the progress of the plating process does not dissolve the anode 21 and accordingly does not change the shape of the anode 21. This does not change the positional relationship (distance) between the anode mask 250 and the surface of the anode 21. This accordingly prevents a change in the electric field between the anode 21 and the substrate W, which is caused by a change in the positional relationship between the anode mask 250 and the surface of the anode 21.

The plating apparatus 10 further includes a regulation plate (intermediate mask) 60 configured to regulate the electric current between the anode 21 and the substrate W. The relation plate 60 is, for example, a substantially plate-like member made of a dielectric material and is placed between the anode mask 250 and the substrate holder 11 (the substrate W). The regulation plate 60 has an opening 60*a* provided to allow electric current (electric field) flowing between the anode 21 and the substrate W to pass through.

It is preferable that the opening 60*a* has a diameter that is smaller than the diameter of the substrate W. As described later, the regulation plate 60 is configured to allow the diameter of the opening 60*a* to be regulated.

It is preferable that the regulation plate 60 is located at a position closer to the substrate holder 11 than the middle position between the anode holder 20 and the substrate holder 11. The arrangement of the regulation plate 60 at the position as close as possible to the substrate holder 11 enables the film thickness in a circumferential portion of the substrate W to be controlled with the higher accuracy.

A paddle 18 is provided between the regulation plate 60 and the substrate holder 11 to stir the plating solution Q in the vicinity of the plating surface W1 of the substrate W. The paddle 18 is a substantially rod-like member and is provided inside of the plating tank 39 such as to face in a vertical direction. The paddle 18 has one end fixed to a paddle driving device 19. The paddle 18 is horizontally moved along the plating surface W1 of the substrate W by the paddle driving device 19, so as to stir the plating solution Q.

Figure 3:
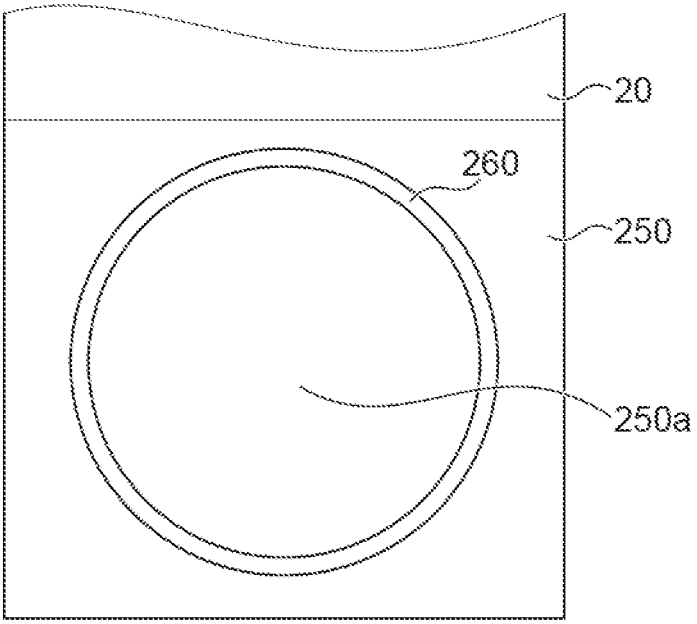
FIG. 3 is a schematic front view illustrating an anode mask.
Figure 4:
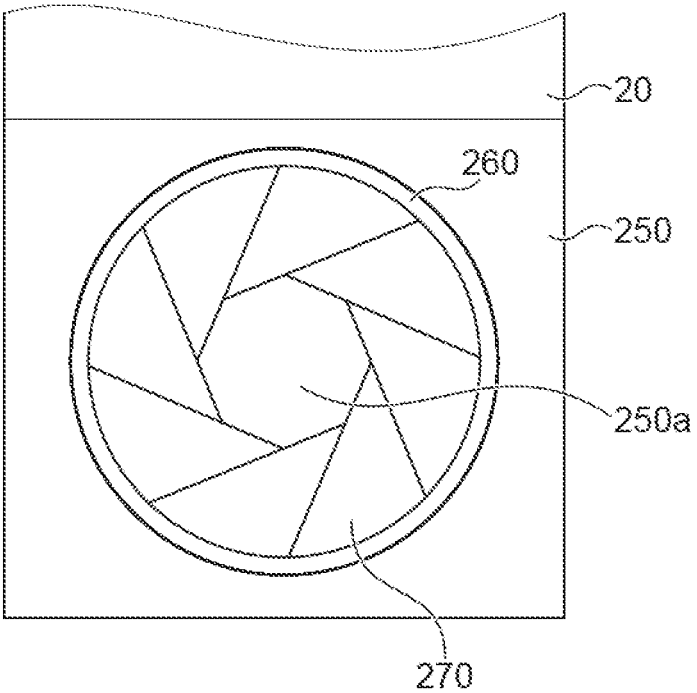
FIG. 4 is a schematic front view illustrating another anode mask.

The following describes in detail the anode mask 250 shown in FIG. 2. FIG. 3 and FIG. 4 are schematic front views illustrating the anode mask 250. FIG. 3 illustrates the anode mask 250 having a relatively large diameter of the opening 250*a*. FIG. 4 illustrates the anode mask 250 having a relatively small diameter of the opening 250*a*. The smaller diameter of the opening 250*a* of the anode mask 250 causes the electric current flowing from the anode 21 to the substrate W to be more concentrated in a center area on the plating surface W1 of the substrate W. The smaller diameter of the opening 250*a* accordingly tends to increase the film thickness in the center area on the plating surface W1 of the substrate W.

As shown in FIG. 3, the anode mask 250 has a substantially ring-shaped edge portion 260. The opening 250*a* of the anode mask 250 shown in FIG. 3 has the maximum diameter. The diameter of the opening 250*a* in this state is equal to the inner diameter of the edge portion 260.

As shown in FIG. 4, the anode mask 250 has a plurality of aperture blades 270 (opening adjustment member) configured to adjust the opening 250*a*. The aperture blades 270 cooperate with one another to define the opening 250*a*. The respective aperture blades 270 have a similar structure to that of a diaphragm mechanism of a camera to increase or decrease the diameter of the opening 250*a* (to adjust the dimensions of the opening 250*a*). The opening 250*a* of the anode mask 250 shown in FIG. 4 is formed in a non-circular shape (for example, in a polygonal shape) by the aperture blades 270. The diameter of the opening 250*a* in this state denotes a shortest distance between opposed sides of a polygon or denotes a diameter of a circle inscribed in the polygon. The diameter of the opening 250 may also be defined by a diameter of a circle having an equivalent area to an opening area. The distance between the anode 21 and faces of the aperture blades 270 opposed to the anode 21 is, for example, not less than 0 mm and not greater than 8 mm.

Figure 5:
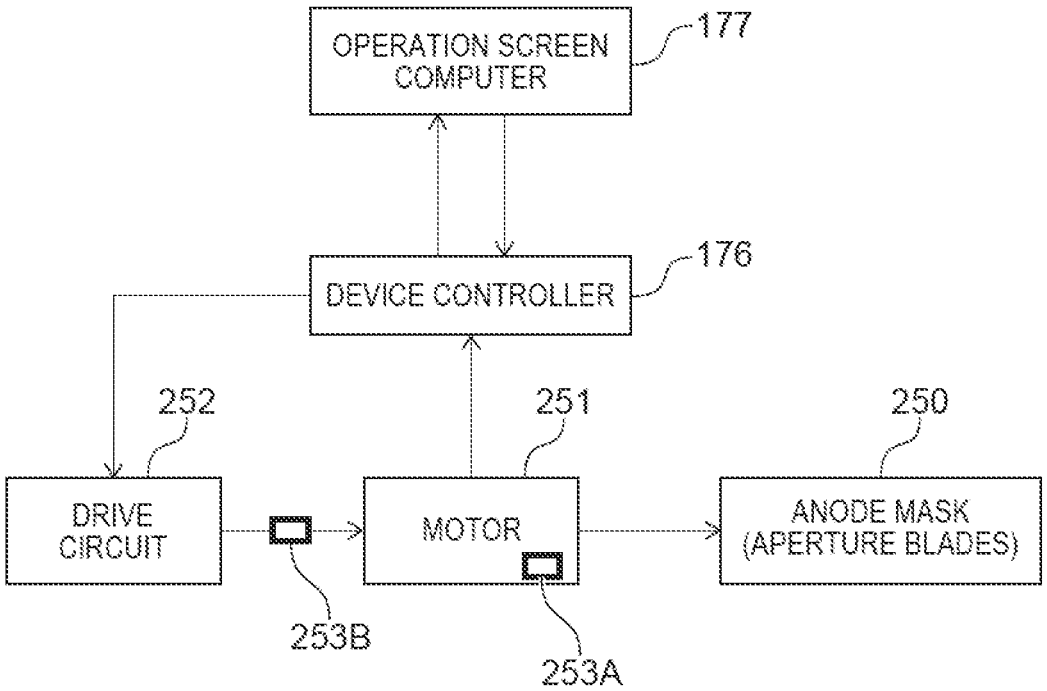
FIG. 5 is a schematic diagram illustrating a system configuration involved in abnormality detection control.

The respective aperture blades 270 are configured to be driven by utilizing a driving force from a motor 251 (shown in FIG. 5). The adjustment mechanism using the aperture blades 270 is characterized by a configuration that enables the diameter of the opening 250*a* to be varied in a relatively wide range. In the case of a circular substrate, it is preferable that the opening 250*a* of the anode mask 250 has a circular shape. In the opening 250*a* having the diameter variable in the relatively wide range, however, there is a mechanistic difficulty in keeping a perfect circular shape in the entire range from a minimum diameter to a maximum diameter. In general, when the opening which the electric current flowing between the anode 21 and the substrate W passes through does not have a perfect circular shape, the electric field has an uneven azimuthal distribution. This may cause the shape of the opening to be transferred to a plating film thickness distribution formed in the circumferential portion of the substrate W. The configuration that the anode mask 250 is integrally mounted to the anode holder 20, however, assures a sufficient distance from the substrate W and minimizes the effect on the plating film thickness distribution even in the case of the opening that does not have the perfect circular shape.

FIG. 5 is a schematic diagram illustrating a system configuration involved in abnormality detection control. A device controller 176 and an operation screen computer 177 shown in this drawing are one example of components included in the control module 175. The operation screen computer 177 is a computer used to input set parameters of the respective devices, a recipe of the processing in the plating apparatus, and the like into the device controller 176 and includes, for example, a display device such as a monitor and an input device such as a keyboard or a mouse. The operation screen computer 177 sets a threshold value with regard to an amount of change in load factor of the motor 251 per unit time (rate of change in load factor) described later, in the device controller 176. The operation screen computer 177 also receives an alarm notification to be notified of an abnormality of the anode mask 250 by the device controller 176.

The device controller 176 controls the respective parts of the plating apparatus, based on the set parameters of the respective devices and the recipe set by the operation screen computer 177 as well as programs and the like and is configured by, for example, a PLC or a sequencer. The device controller 176 may have any of the configurations described above as the configuration of the control module 175. The device controller 176 outputs a control signal to a drive circuit 252 based on the recipe, so as to drive (move) the aperture blades 270 and accordingly make the opening diameter (opening dimension) of the anode mask 250 equal to a set value of the recipe. The device controller 176 is also configured to receive a detection value (feedback signal) of motor current or motor load factor from the motor 251 or to receive a detection value (feedback signal) of motor current from an ammeter connected with the motor 251 and to perform an abnormality detection process of the anode mask 250.

According to the embodiment, as shown in FIG. 5, the aperture blades 270 of the anode mask 250 are driven (moved) by the power of the motor 251. The motor 251 may be built in the anode mask 250 or may be provided outside of the anode mask 250. The motor 251 may be connected with the aperture blades 270 of the anode mask 250 via a speed reducer (not shown). The motor 251 employable herein may be a motor configured to output a motor current and/or a motor load factor detected by an ammeter and/or a detection circuit 253A built therein. The detection circuit is a load factor detection circuit configured to calculate/detect the motor load factor, based on a detection value of the motor current. The motor current and/or the motor load factor detected by the motor 251 is output to the device controller 176. A modified configuration may detect the motor current and/or the motor load factor of the motor 251 by a separate ammeter and/or a separate detection circuit 253B connected with the motor 251 and output the detected motor current and/or motor load factor to the device controller 176. Both of or only either one of the ammeter and/or detection circuit 253A and the ammeter and/or detection circuit 253B may be provided. The abnormality detection control may use both the outputs or only either one of the outputs from the ammeter and/or detection circuit 253A and the ammeter and/or detection circuit 253B The motor 251 is driven with electric power (electric current) supplied from the drive circuit 252. The drive circuit 252 receives a supply of electric power from a non-illustrated power supply, generates electric current for driving the motor 251, based on a control signal from the controller 175, and supplies the generated electric current to the motor 251. The drive circuit 252 may be configured by a switching circuit, a DC/DC converter or the like.

Figure 6A:
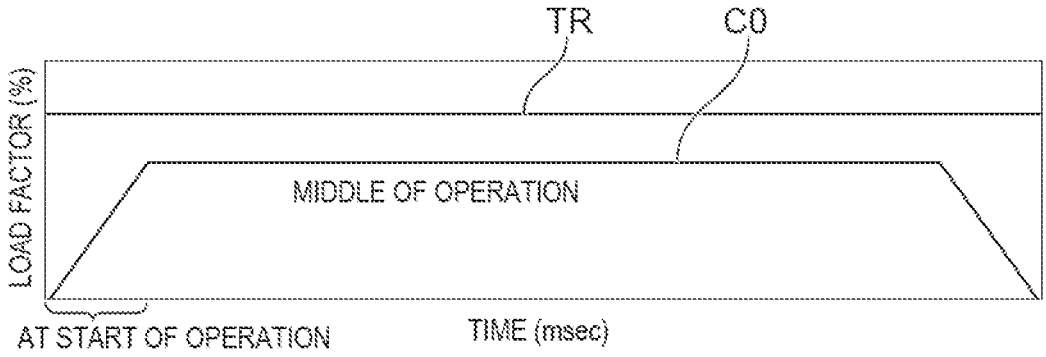
FIG. 6A is a graph showing a time change of motor load factor during operation of the anode mask.
Figure 6B:
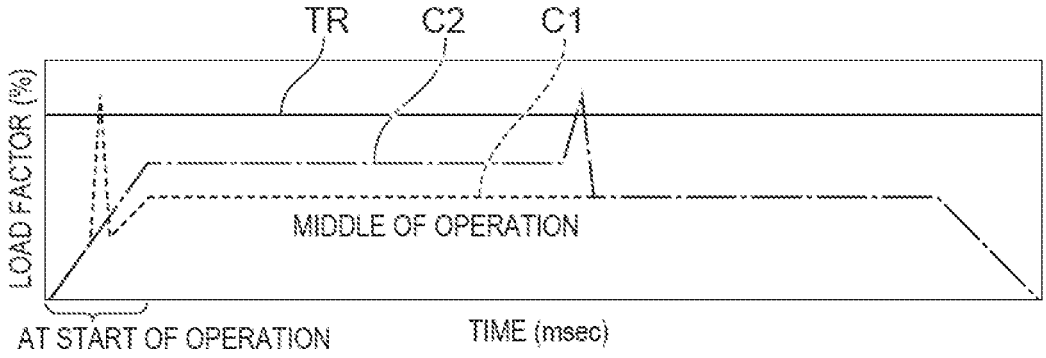
FIG. 6B is another graph showing a time change of motor load factor during operation of the anode mask.
Figure 6C:
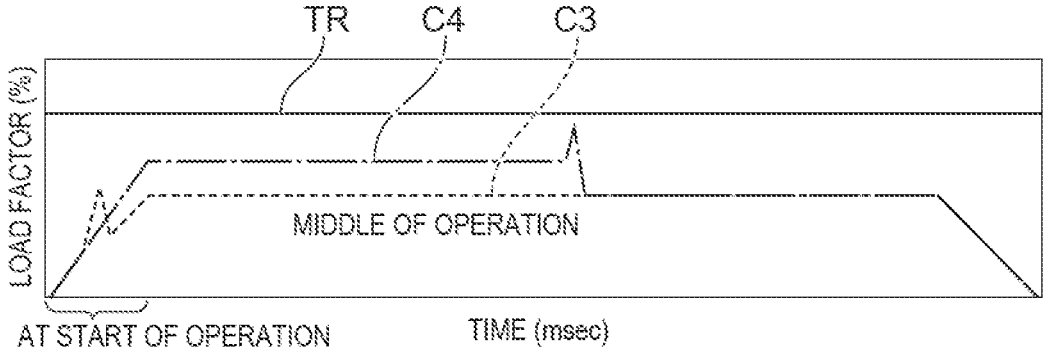
FIG. 6C is another graph showing a time change of motor load factor during operation of the anode mask.

FIGS. 6A to 6C are graphs showing time changes of motor load factor during operation of the anode mask. FIG. 6A illustrates a motor load factor curve C0 during operation of the anode mask in a normal state. FIG. 6B illustrates motor load factor curves C1 and C2 in the case where an abnormality of the anode mask is detectable by using a threshold value of the motor load factor. FIG. 6C illustrates motor load factor curves C3 and C4 in the case where an abnormality of the anode mask is undetectable by using the threshold value of the motor load factor.

The motor load factor is defined as a ratio of a motor current value to a rated current value and is expressed by a mathematical expression given below:

$$\text{Motor load factor}=\text{Motor current value}[A]/\text{Rated current value}[A]\times 100[\%]$$

A change rate in motor load factor (also referred to as motor load factor change rate) denotes an amount of change in the motor load factor per unit time and corresponds to slopes of the motor load factor curves shown in FIG. 6A to FIG. 6C.

The threshold value of the motor load factor (also referred to as load factor threshold value) TR is set as a reference value used to detect an abnormality of the anode mask 250, based on the motor load factor. An abnormality of the anode mask 250 is detected when the motor load factor exceeds the load factor threshold value TR. The abnormality of the anode mask 250 includes abnormalities of the aperture blades 270 (opening adjustment member), the motor 251, the drive circuit 252 and other parts relating to the operation of the anode mask 250.

As shown in FIG. 6A, when the anode mask 250 is normal, the motor load factor starts increasing at the start of supply of motor current (at or during the start of operation of the anode mask 250), is kept unchanged with saturation to a fixed value (in the middle of operation of the anode mask 250), and then decreases (at the end of operation of the anode mask 250). During this entire time period, the motor load factor does not exceed the load factor threshold value TR as shown by the curve C0. "At or during the start of operation" of the anode mask 250 denotes a time period from a start of supply of electric current to the motor 251 to saturation of the increasing motor load factor (a time period when the motor load factor increases linearly in FIG. 6A to FIG. 6C). "In the middle of operation" of the anode mask 250 denotes a time period after the saturation of the motor load factor. The motor load factor at or during the start of operation may not necessarily increase linearly but may have a change in another shape. The motor load factor in the middle of operation may not necessarily be kept at the fixed value but may have a change in another shape. The motor load factor at the end of operation may not necessarily decrease linearly but may have a change in another shape.

As shown by the motor load factor curve C1 in FIG. 6B, when the motor load factor has a change exceeding the load factor threshold value TR at or during the start of operation of the anode mask, an abnormality of the anode mask 250 is detectable, based on the motor load factor. As shown by the motor load factor curve C2 in FIG. 6B, when the motor load factor has a change exceeding the load factor threshold value TR in the middle of operation of the anode mask, an abnormality of the anode mask 250 is detectable.

As shown by the motor load factor curve C3 in FIG. 6C, on the other hand, even when an abnormality of the anode mask 250 occurs at or during the start of operation of the anode mask, in the case where the motor load factor does not exceed the load factor threshold value TR, the abnormality of the anode mask 250 is not detectable. As shown by the motor load factor curve C4 in FIG. 6C, even when an abnormality of the anode mask 250 occurs in the middle of operation of the anode mask, in the case where the motor load factor does not exceed the load factor threshold value TR, the abnormality of the anode mask 250 is not detectable. In the actual use, the threshold value for detection of an abnormality may be set to a slightly higher value with a view to preventing misdetection of a failure of the anode mask. Even when the anode mask 250 has an abnormality, this may cause a change of the motor load factor exceeding the load factor threshold value TR to be not detected. Especially at or during the start of operation of the anode mask, the value of the motor current and the value of the motor load factor are small. This may cause the motor load factor not to exceed the load factor threshold value TR even when the anode mask has an abnormality. There is accordingly a difficulty in detecting an abnormality.

Figure 7:
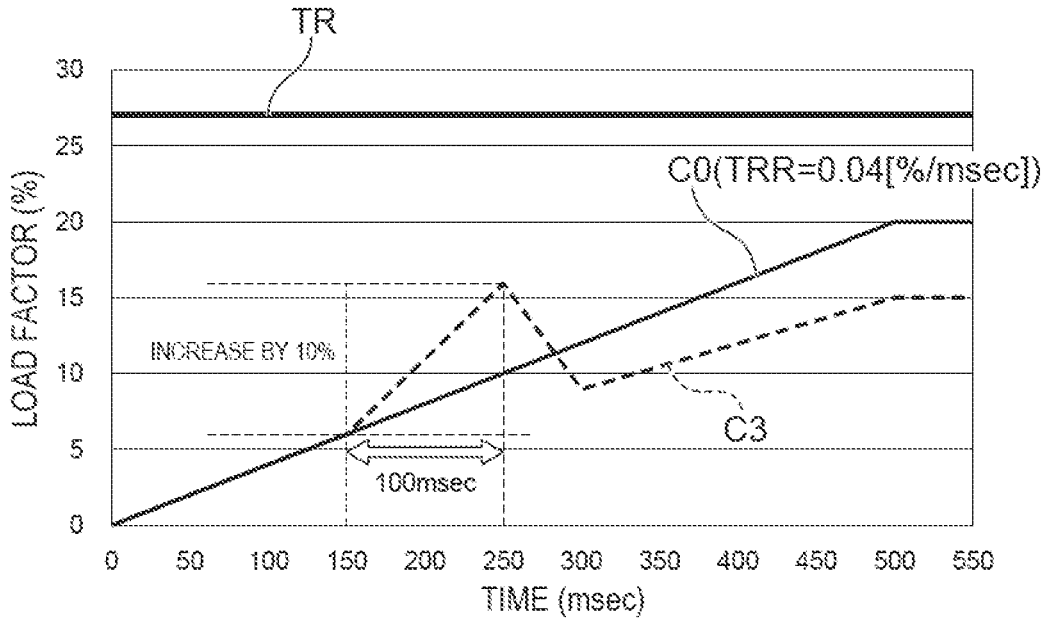
FIG. 7 is an explanatory view illustrating the principle of abnormality detection according to one embodiment.

FIG. 7 is an explanatory view illustrating the principle of abnormality detection according to one embodiment. This illustrates close-up at or during the start of operation in the motor load factor curve C3 shown in FIG. 6C. As shown in FIG. 7, even when the motor load factor curve C3 shows a change deviating from the motor load factor curve C0 in the normal state at or during the start of operation of the anode mask, an abnormality of the anode mask is not detectable unless the motor load factor curve C3 exceeds the load factor threshold value TR. The configuration of this embodiment detects an amount of change in the motor load factor per unit time (motor load factor change rate) and compares the detected motor load factor change rate with a threshold value of the motor load factor change rate (also referred to as load factor change rate threshold value) TRR to detect an abnormality of the anode mask.

For example, in FIG. 7, in the motor load factor curve C0 in the normal state, the motor load factor changes from 0% to 20% for a time period of 500 msec at or during the start of operation, so that the motor load factor change rate is 20 [%]/500 [msec]=0.04 [%/msec]. The load factor change rate threshold value TRR is accordingly set to 0.04 [%/msec]. In the motor load factor curve C3, on the other hand, the motor load factor increases from 6% to 16% by 10% for a time period of 100 msec from a time point of 150 msec to a time point of 250 msec, so that the motor load factor change rate is 10 [%], 100 [msec]=0.10 [%/msec]. The motor load factor change rate of 0.10 [%/msec] in the motor load factor curve C3 from the time point of 150 msec to the time point of 250 msec exceeds the threshold value of the motor load factor change rate of 0.04 [%/msec]. This accordingly enables an abnormality of the anode mask 250 to be detected. The load factor change rate threshold value TRR may be set by adding a predetermined tolerance to the load factor change rate based on the motor load factor curve C0 in the normal state, with a view to preventing misdetection of an abnormality (load factor change rate threshold value TRR>load factor change rate based on the motor load factor curve C0 in the normal state). FIG. 7 illustrates the example of calculating the motor load factor change rates from the amounts of change in the load factor for the time period of 500 msec and for the time period of 100 msec, for the purpose of illustration to facilitate understanding of the principle of detection. The detection time (sampling time) for detecting the motor load factor change rate may, however, be set arbitrarily in the range of performances of a detector and an operation circuit. In the actual control, the detection time may be about a few msec.

Figure 8:
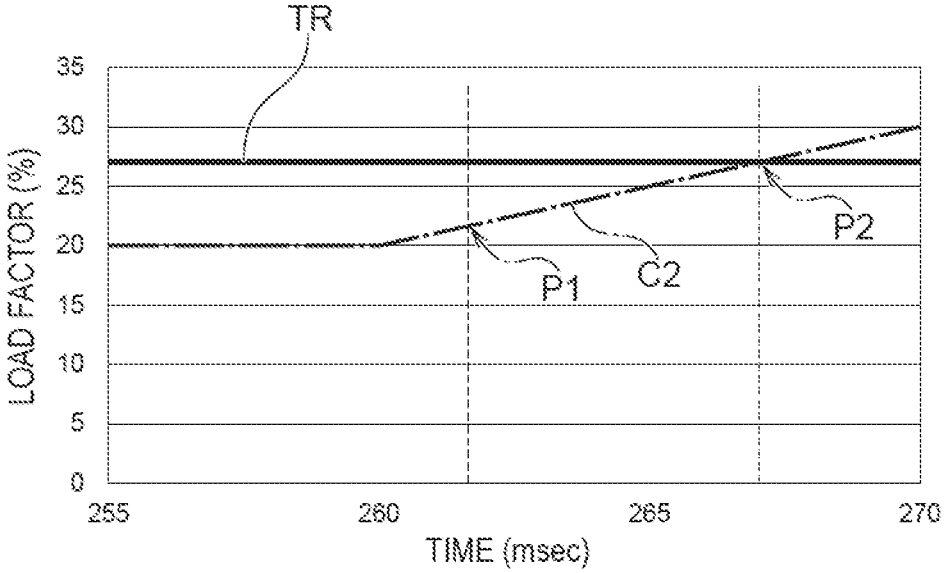
FIG. 8 is an explanatory view illustrating the timing of abnormality detection according to one embodiment.

FIG. 8 is an explanatory view illustrating the timing of abnormality detection according to one embodiment. In the motor load factor curve C2 shown in FIG. 8, the motor load factor starts increasing at a time point of 260 msec in the middle of operation (during saturation of the motor load factor) and exceeds the load factor threshold value TR at a time point of 267 msec (at a time point P2). A conventional abnormality detection method using the load factor threshold value TR requires a time duration of 7 msec to detect an abnormality of the anode mask since a start of change of the motor load factor (since a start of deviation from the value in the normal state). An abnormality detection method using the load factor change rate threshold value TRR according to the embodiment, on the other hand, detects an abnormality of the anode mask at a time point P1 after a few msec since a start of change of the motor load factor at the time point of 260 msec (since a start of deviation from the value in the normal state). This time of actual detection is determined according to a sampling cycle of detecting the motor load factor change rate or according to an abnormality detection control cycle of detecting the motor load factor change rate and comparing the detected motor load factor change rate with the threshold value TRR. The abnormality detection method of the embodiment (the method comparing with the load factor change rate threshold value TRR) allows an abnormality to be detected at an earlier timing and enables the operation of the anode mask to be stopped before the anode mask is actually damaged, compared with the conventional abnormality detection method (the method comparing with the load factor threshold value TR).

Unlike the setting of the conventional detection method (using the load factor threshold value TR), the configuration of this embodiment has a smaller time lag to detect that the load factor change rate exceeds the load factor change rate threshold value TRR since a start of an increase in the load factor (since a start of deviation of the load factor). This enables an abnormality to be detected at an earlier timing and allows for detection of an abnormality and stop of operation of the anode mask before the anode mask is damaged.

Figure 9:
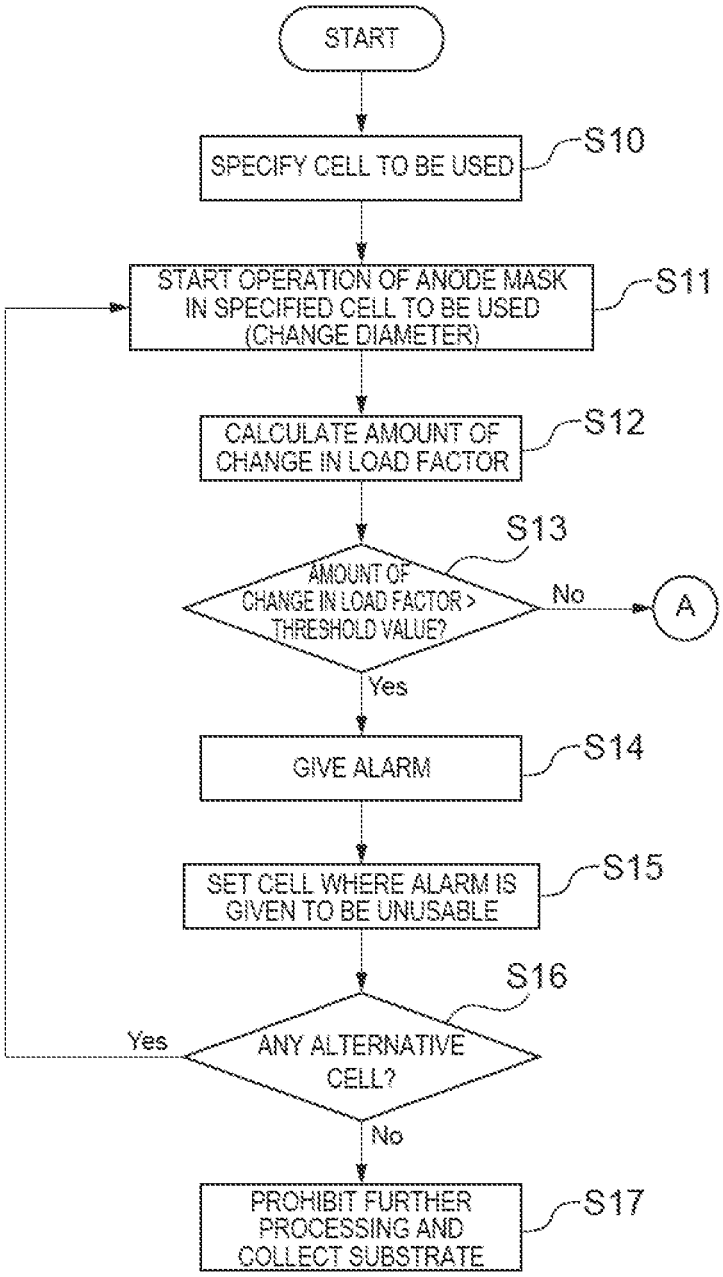
FIG. 9 is a flowchart of abnormality detection according to one embodiment.
Figure 10:
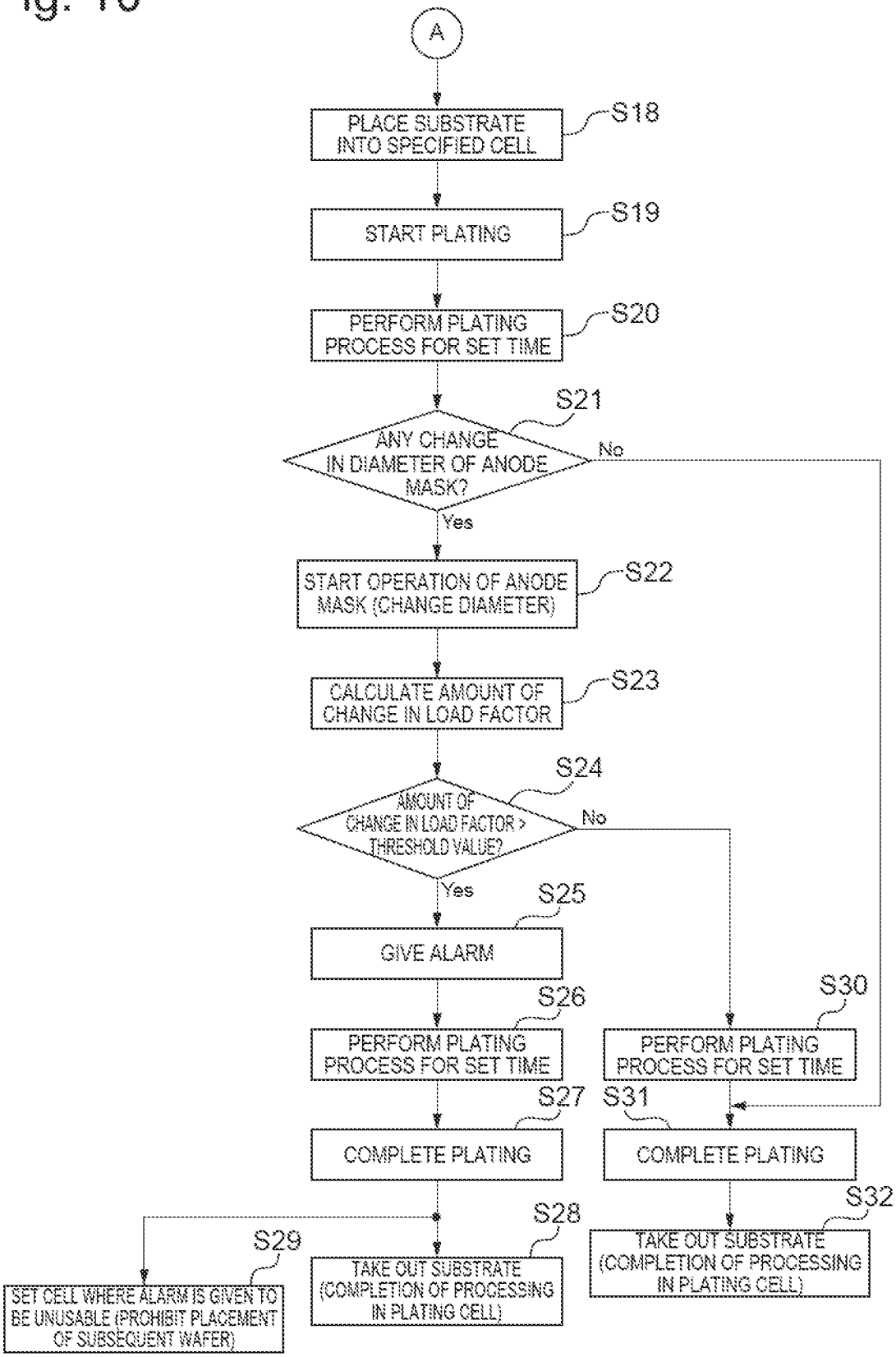
FIG. 10 is a flowchart of abnormality detection according to the embodiment.

FIG. 9 and FIG. 10 are flowcharts of abnormality detection according to one embodiment.

At step S10, the abnormality detection flow specifies a plating cell to be used among a plurality of plating cells with regard to each substrate that is expected to be processed by a plating process. At step S11, the abnormality detection flow starts operation of the anode mask 250 (starts driving of the aperture blades 270 by the motor 251), in order to change the opening diameter (opening dimension) of the anode mask 250 in the specified plating cell to be used. At step S12, the abnormality detection flow obtains the motor current or the motor load factor of the motor 251 used to drive the anode mask 250 from the ammeter and/or detection circuit 253A (the ammeter and/or detection circuit 253B) and calculates the motor load factor change rate that is the amount of change in the motor load factor per unit time (detection of the motor load factor change rate). At step S13, the abnormality detection flow determines whether the detected motor load factor change rate exceeds the load factor change rate threshold value TRR. When the motor load factor change rate does not exceed the load factor change rate threshold value TRR as a result of determination, the abnormality detection flow proceeds to step S18 in FIG. 10. When the motor load factor change rate exceeds the load factor change rate threshold value TRR, on the other hand, the abnormality detection flow gives an alarm (step S14) and stops placement of the substrate into the plating cell where the alarm is given, sets this plating cell to be unused/unusable and prohibits placement of a subsequent substrate into this plating cell (step S15). The abnormality detection flow subsequently determines whether there is any alternative plating cell to process the substrate that was expected to be processed in the originally specified plating cell (step S16). When there is any alternative plating cell, the abnormality detection flow goes back to step S10 to newly determine the alternative plating cell as a plating cell to be used for the substrate and repeats the processing of and after step S11. When there is no alternative plating cell, on the other hand, the abnormality detection flow determines that further processing is not allowed and thereby collects the substrate (step S17).

When the detected motor load factor change rate does not exceed the load factor change rate threshold value TRR at step S13, the abnormality detection flow places the substrate into the specified plating cell (step S18), starts a plating process of the substrate (step S19) and performs the plating process for a set time (step S20). At step S21, the abnormality detection flow subsequently determines whether there is a change in the opening diameter of the anode mask 250. When there is no change in the opening diameter of the anode mask 250, the abnormality detection flow completes the plating process (step S31) and takes out the processed substrate (step S32).

When it is determined at step S21 that there is a change in the opening diameter of the anode mask 250, the abnormality detection flow proceeds to step S22. At step S22, the abnormality detection flow starts operation of the anode mask 250, in order to change the opening diameter of the anode mask 250 (starts driving the aperture blades 270 by the motor 251). At step S23, the abnormality detection flow obtains the motor current or the motor load factor of the motor 251 used to drive the anode mask 250, and calculates the motor load factor change rate that is the amount of change in the motor load factor per unit time (detection of the motor load factor change rate). At step S24, the abnormality detection flow determines whether the detected motor load factor change rate exceeds the load factor change rate threshold value TRR. When the motor load factor change rate does not exceed the load factor change rate threshold value TRR as a result of determination, the abnormality detection flow performs a plating process for a set time (step S30). The abnormality detection flow then completes the plating process (step S31) and takes out the substrate (step S32). After the processing of step S30, the abnormality detection flow may be returned to step S21 to further determine whether there is a change in the opening diameter of the anode mask 250.

When the motor load factor change rate exceeds the load factor change rate threshold value TRR at step S24, on the other hand, the abnormality detection flow gives an alarm (step S25), the abnormality detection flow performs a plating process of the substrate for a set time (step S26), completes the plating process (step S27) and takes out the substrate (step S28), while setting the plating cell where the alarm is given to be unused, unusable and prohibiting placement of a subsequent substrate into this plating cell (step S29).

The configuration of the embodiment monitors the motor load factor change rate and detects an abnormality of the anode mask 250 when the motor load factor change rate exceeds the load factor change rate threshold value TRR. This configuration enables an abnormality of the anode mask to be detected even at or during the start of operation of the anode mask having a small motor current value and a small motor load factor.

The configuration of the embodiment is allowed to detect that the motor load factor change rate exceeds the load factor change rate threshold value TRR, even before the motor load factor reaches the load factor threshold value TR. This configuration significantly reduces the time lag from a start of deviation of the motor load factor from a normal value to actual detection of an abnormality and thereby enables an abnormality of the anode mask to be detected in a shorter time period. This more reliably enables the operation of the anode mask to be stopped before the anode mask is actually damaged.

Other Embodiments (1) The above embodiment describes the configuration of adjusting the diameter of the opening of the anode mask used for a circular substrate. In the case of a rectangular opening like the anode mask for a rectangular substrate described in Patent Document 2, a modification may be configured to adjust the dimension of the opening such as to change a length in at least one direction (a vertical direction or a lateral direction) of the opening. In the description hereof, adjusting the dimension of the opening includes adjusting the diameter of the opening.

(2) The above embodiment describes the configuration of detecting an abnormality of the anode mask. This configuration may, however, be applicable to detect an abnormality in another device that is driven by a motor. For example, in the case where the dimension of an opening in another electric field regulating member such as a regulation plate (intermediate mask) is adjusted by means of the motor, the configuration of the above embodiment may be employed to detect an abnormality of such an electric field regulating member. The configuration of the above embodiment may also be employed to detect an abnormality in any arbitrary device that is driven by a motor.

The present disclosure may be implemented by aspects described below:

[1] According to one aspect, there is provided an apparatus for plating a substrate, comprising: an anode placed to be opposed to the substrate; an electric field regulating member placed between the substrate and the anode, provided with an opening, and equipped with an opening adjustment member configured to change a dimension of the opening; a motor configured to drive the opening adjustment member; and a control device configured to obtain an electric current value or a load factor of the motor, to calculate an amount of change in the load factor of the motor per unit time from the obtained electric current value or the obtained load factor of the motor, and to detect an abnormality of the electric field regulating member when it is detected that the amount of change in the load factor of the motor per unit time exceeds a predetermined threshold value.

The configuration of this aspect monitors a motor load factor change rate (the amount of change in the load factor of the motor per unit time) and detects an abnormality ofthe electric field regulating member when the motor load factor change rate exceeds a load factor change rate threshold value (the predetermined threshold value). This configuration enables an abnormality of the electric field regulating member to be detected with higher accuracy even when the electric current value and the load factor of the motor are small (for example, at or during start of operation).

This configuration allows for detection that the amount of change in the load factor of the motor per unit time exceeds the predetermined threshold value (load factor change rate threshold value), even before a motor load factor (the load factor of the motor) exceeds a motor load factor threshold value (a predetermined reference value). This configuration thus significantly reduces a time lag from a start of deviation of the load factor of the motor from a normal value to actual detection of an abnormality and enables an abnormality of the electric field regulating member to be detected in a shorter time period. This configuration more readily enables an abnormality to be detected before the electric field regulating member is damaged, and stops the electric field regulating member.

[2] According to one aspect, in the apparatus for plating, the control device may detect an abnormality of the electric field regulating member at or during start of operation of the opening adjustment member that is a time period from a start of an increase in electric current of the motor to saturation of the electric current of the motor.

The configuration of this aspect enables an abnormality of the electric field regulating member to be detected with higher accuracy at or during the start of operation of the electric field regulating member when the electric current value and the load factor of the motor are small.

[3] According to one aspect, in the apparatus for plating, the control device may detect that the amount of change in the load factor of the motor per unit time exceeds the predetermined threshold value, based on the electric current value of the motor, and detect an abnormality of the electric field regulating member, before the load factor of the motor exceeds a predetermined reference value in middle of operation after a start of the operation of the opening adjustment member to change the dimension of the opening.

The configuration of this aspect detects that the amount of change in the load factor of the motor per unit time exceeds the predetermined threshold value and detects an abnormality, before the load factor of the motor exceeds the motor load factor threshold value. This configuration more readily enables an abnormality to be detected before the electric field regulating member is damaged, and stops the electric field regulating member.

[4] According to one aspect, the apparatus for plating may comprise a plurality of plating cells, each having the anode and the electric field regulating member. The control device may specify a plating cell that is to be used to process the substrate by a plating process, start driving the opening adjustment member of the electric field regulating member prior to placement of the substrate into the specified plating cell, and when it is detected that the amount of change in the load factor of the motor per unit time exceeds the predetermined threshold value with regard to the specified plating cell, stop the placement of the substrate into the specified plating cell.

The configuration of this aspect enables an abnormality of the electric field regulating member with regard to the specified plating cell to be detected with high accuracy before the substrate is placed into the specified plating cell, and stops the placement of the substrate into the specified plating cell in response to detection of an abnormality. This configuration accordingly prevents the substrate from being processed by the plating process in the specified plating cell and thereby suppresses or prevents the substrate from being wasted. The substrate that is stopped to be placed into the specified plating cell is allowed to be placed into another plating cell to be processed by a plating process.

[5] According to one aspect, in the apparatus for plating, the control device may determine whether there is another plating cell that is usable for placement of the substrate, which is stopped to be placed into the specified plating cell, and when there is another plating cell that is usable for placement of the substrate, place the substrate into the another plating cell.

The configuration of this aspect causes the substrate that is stopped to be placed in the specified plating cell, to be placed into another plating cell and to be processed by a plating process. This configuration accordingly reduces a decrease in throughput.

[6] According to one aspect, in the apparatus for plating, the control device may perform changing the dimension of the opening of the electric field regulating member multiple times with regard to the plating process for one substrate. Every time changing the dimension of the opening of the electric field regulating member is performed, the control device may perform a process of detecting an abnormality of the electric field regulating member, based on the amount of change in the load factor of the motor per unit time.

The configuration of this aspect performs the process of detecting an abnormality of the electric field regulating member every time the adjustment of the dimension of the electric field regulating member is performed. This configuration accordingly enables an abnormality of the electric field regulating member to be detected with higher accuracy at an earlier timing.

[7] According to one aspect, in the apparatus for plating, the control device may perform changing the dimension of the opening of the electric field regulating member after a start of the plating process of the substrate, continue the plating process of the substrate when an abnormality of the electric field regulating member is detected with regard to the specified plating cell, and subsequently set the specified plating cell to be unused or unusable.

Even when an abnormality of the electric field regulating member is detected, the substrate may be plated normally in some cases. In the case where an abnormality of the electric field regulating member is detected after start of a plating process, the configuration of this aspect continues the plating process of the substrate and completes plating of the substrate. This configuration suppresses the substrate from being scrapped as much as possible.

[8] According to one aspect, in the apparatus for plating, the electric field regulating member may be an anode mask placed between the substrate and the anode to be located at a position closer to the anode than the substrate.

The configuration of this aspect has the functions and the advantageous effects described above with regard to the anode mask.

[9] According to one aspect, there is provided a method of plating a substrate, comprising: driving an opening adjustment member by a motor, wherein the opening adjustment member is configured to change a dimension of an opening provided in an electric field regulating member that is placed between the substrate and an anode; and obtaining an electric current value or a load factor of the motor, calculating an amount of change in the load factor of the motor per unit time from the obtained electric current value or the obtained load factor of the motor, and detecting an abnormality of the electric field regulating member when it is detected that the amount of change in the load factor of the motor per unit time exceeds a predetermined threshold value.

[10] According to one aspect, there is provided a storage medium configured to store a program that causes a computer to perform a method of detecting an abnormality of an electric field regulating member of a plating apparatus, wherein the program causes the computer to perform; driving an opening adjustment member by a motor, wherein the opening adjustment member is configured to change a dimension of an opening provided in an electric field regulating member that is placed between the substrate and an anode; and obtaining an electric current value or a load factor of the motor, calculating an amount of change in the load factor of the motor per unit time from the obtained electric current value or the obtained load factor of the motor, and detecting an abnormality of the electric field regulating member when it is detected that the amount of change in the load factor of the motor per unit time exceeds a predetermined threshold value.

Although the embodiments of the present invention have been described based on some examples, the embodiments of the invention described above are presented to facilitate understanding of the present invention, and do not limit the present invention. The present invention can be altered and improved without departing from the subject matter of the present invention, and it is needless to say that the present invention includes equivalents thereof. In addition, it is possible to arbitrarily combine or omit the embodiments and the modifications described above and it is also possible to arbitrarily combine or omit respective constituent elements described in the claims and the specification in a range where at least a part of the above-mentioned problem can be solved or a range where at least a part of the effect is exhibited.

REFERENCE SIGNS LIST

11 substrate holder
20 anode mask
21 anode
38 overflow tank
39 plating tank (plating cells)
40 plating module
50 cleaning module
60 regulation plate
60*a* opening
110 load/unload station
120 processing station
120A preprocess and postprocess station
120B plating station
175 control module
175A CPU
175B memory
176 device controller
177 operation screen computer
250 anode mask
250*a* opening
250*b* anode mask mounting element
251 motor

252 drive circuit
253A, 253B ammeter and/or detection circuit
260 edge portion
270 aperture blades

What is claimed is:

1. An apparatus for plating a substrate, comprising:

a plating cell comprising an anode placed to be opposed to the substrate;

an electric field regulating member placed between the substrate and the anode, provided with an opening, and equipped with an opening adjustment member configured to change a dimension of the opening, and a motor configured to drive the opening adjustment member; and a control device configured to obtain an electric current value or a load factor of the motor, to calculate an amount of change in the load factor of the motor per unit time from the obtained electric current value or the obtained load factor of the motor, and to detect an abnormality of the electric field regulating member when it is detected that the amount of change in the load factor of the motor per unit time exceeds a predetermined threshold value, wherein the control device starts driving the opening adjustment member of the electric field regulating member prior to placement of the substrate into the plating cell, obtains the electric current value or the load factor of the motor to calculate an amount of change in the load factor of the motor per unit time at the start of operation of the opening adjustment member that is a time period from a start of an increase in electric current of the motor to saturation of the electric current of the motor, and when it is detected that the amount of change in the load factor of the motor per unit time exceeds the predetermined threshold value, stops the placement of the substrate into the plating cell.

2. The apparatus for plating according to claim 1, wherein the control device further detects that the amount of change in the load factor of the motor per unit time exceeds the predetermined threshold value, based on the electric current value or the load factor of the motor, and detects an abnormality of the electric field regulating member, before the load factor of the motor exceeds a predetermined reference value in middle of operation after the start of the operation of the opening adjustment member to change the dimension of the opening.

3. The apparatus for plating according to claim 1, comprising:

a plurality of the plating cells, wherein the control device specifies a plating cell that is to be used to process the substrate by a plating process, starts driving the opening adjustment member of the electric field regulating member prior to placement of the substrate into the specified plating cell, and when it is detected that the amount of change in the load factor of the motor per unit time exceeds the predetermined threshold value with regard to the specified plating cell, stops the placement of the substrate into the specified plating cell.

4. The apparatus for plating according to claim 3, wherein the control device determines whether there is another plating cell that is usable for placement of the substrate, which is stopped to be placed into the specified plating cell, and when there is another plating cell that is usable for placement of the substrate, places the substrate into the another plating cell.

5. The apparatus for plating according to claim 3, wherein the control device performs changing the dimension of the opening of the electric field regulating member multiple times with regard to the plating process for one substrate, and every time changing the dimension of the opening of the electric field regulating member is performed, the control device performs a process of detecting an abnormality of the electric field regulating member, based on the amount of change in the load factor of the motor per unit time.

6. The apparatus for plating according to claim 5, wherein the control device performs changing the dimension of the opening of the electric field regulating member after a start of the plating process of the substrate, continues the plating process of the substrate when an abnormality of the electric field regulating member is detected with regard to the specified plating cell, and subsequently sets the specified plating cell to be unused or unusable.

7. The apparatus for plating according to claim 1, wherein the electric field regulating member is an anode mask placed between the substrate and the anode to be located at a position closer to the anode than the substrate.

* * * * *